US007041326B2

(12) United States Patent
Bradley et al.

(10) Patent No.: US 7,041,326 B2
(45) Date of Patent: May 9, 2006

(54) FOOD PACKAGE

(75) Inventors: Scott J. Bradley, Poynette, WI (US); Heidi A. Meyer, Madison, WI (US)

(73) Assignee: Kraft Foods Holdings, Inc., Northfield, IL (US)

( * ) Notice: Subject to any disclaimer, the term of this patent is extended or adjusted under 35 U.S.C. 154(b) by 337 days.

(21) Appl. No.: 10/112,591

(22) Filed: Mar. 29, 2002

(65) Prior Publication Data

US 2003/0185943 A1 Oct. 2, 2003

(51) Int. Cl.
*B65D 81/36* (2006.01)

(52) U.S. Cl. ..... 426/112; 426/115; 426/120; 206/541; 206/564

(58) Field of Classification Search ..... 426/115, 426/120, 112, 106, 119, 138; 206/216, 541, 206/542, 545, 562, 563, 564, 565, 499, 585, 206/548, 223, 217; 229/932
See application file for complete search history.

(56) References Cited

U.S. PATENT DOCUMENTS

| | | | | | |
|---|---|---|---|---|---|
| 1,176,932 | A | * | 3/1916 | Smith | 229/102 |
| 1,370,811 | A | * | 3/1921 | Harding et al. | 294/143 |
| 2,357,161 | A | * | 8/1944 | Barbieri | 229/402 |
| 3,883,000 | A | | 5/1975 | Gibbs | |
| 4,018,905 | A | * | 4/1977 | Adamek et al. | 426/124 |
| 4,208,006 | A | * | 6/1980 | Bixler et al. | 229/406 |
| 4,269,316 | A | * | 5/1981 | Growney | 206/499 |
| 4,291,805 | A | * | 9/1981 | Seeley | 206/563 |
| 4,746,010 | A | * | 5/1988 | Fournier | 206/746 |
| D305,205 | S | | 12/1989 | Grindrod et al. | |
| 4,899,884 | A | * | 2/1990 | Madsen | 206/499 |
| 5,009,902 | A | * | 4/1991 | Mercenari | 426/138 |
| 5,203,493 | A | * | 4/1993 | Moody | 229/103 |
| D362,593 | S | * | 9/1995 | Fish | D7/504 |
| 5,657,873 | A | | 8/1997 | Hustad et al. | |
| 5,747,084 | A | * | 5/1998 | Cochran et al. | 426/120 |
| 5,919,501 | A | * | 7/1999 | Rozzano | 426/87 |
| 5,922,376 | A | | 7/1999 | Privert | |
| 5,979,656 | A | * | 11/1999 | Northcott et al. | 206/564 |
| 6,048,558 | A | | 4/2000 | Feldmeier et al. | |
| 6,092,664 | A | | 7/2000 | Bartosek | |
| D443,510 | S | | 6/2001 | Docette | |
| 2002/0119229 | A1 | * | 8/2002 | Zimmerman et al. | 426/520 |

FOREIGN PATENT DOCUMENTS

| | | | | |
|---|---|---|---|---|
| CA | 2319887 | A1 | * | 3/2001 |
| EP | 677454 | A1 | * | 10/1995 |
| EP | 1053682 | A2 | * | 11/2000 |
| EP | 1157614 | A2 | * | 11/2001 |
| FR | 2553386 | A1 | * | 4/1985 |

* cited by examiner

*Primary Examiner*—Milton I. Cano
*Assistant Examiner*—Robert Madsen
(74) *Attorney, Agent, or Firm*—Fitch, Even, Tabin & Flannery

(57) ABSTRACT

A food package is provided that includes a compartment in which food items are carried and a holder portion which allows a user to place the food item therein with the food item held in a stationary position. The food holder can serve as a staging area for combining the food item with other food items or can be used as a placement location for a partially eaten food item. In the preferred multicompartment package, an improved back card construction is also disclosed.

10 Claims, 9 Drawing Sheets

FOOD PACKAGE

FIELD OF THE INVENTION

The present invention relates to food packaging and, more particularly, to food packages having a compartmentalized base with read-to-eat food items retained therein by a thin film attached to the base and over the compartments.

BACKGROUND OF THE INVENTION

Single containers or "kits" of several food products or items have become increasingly popular, particularly for children such as the Lunchables® product line offered by the Assignee herein. These packages include the components for an essentially complete snack or meal in one convenient container. For example, a kit may include a serving of cookies in a main compartment, and have frosting and/or other candy toppings in other smaller compartments of the package. In this way, when the package is opened, a user can pull out the cookies and apply the frosting and toppings as desired thereto. Another example is pizza packages where the pizza crust is in one compartment and toppings including sauce and the like are in the other compartments. The illustrated package herein contains cones, filling and toppings, each in separate compartments.

In providing packaging for such kits, several considerations must be addressed. Because the food items in the kit generally are of a ready-made variety that typically requires little or no preparation by the consumer, the kits are desirable for consumption away from home. For example, parents can send children to school with these package for lunch to provide the parents with the convenience of prepackaged lunches that the children can easily assemble, if needed at lunchtime in school cafeterias. This usage requires that the kits be contained in compact, well-sealed containers that can be easily packed away and/or carried by children. Where the food item in the main compartment is to be combined with food filling or topping-type items in the other compartments, one problem is the requirement that the child remove the food item from the main compartment for ease in the application of the added food items thereto. Because children are typically of limited coordination, generally they undesirably will have to set this item down somewhere such as on a potentially dirty table at school to apply the added food items using one hand to hold the base and the other to remove and apply the added food items.

Environmental and economic concerns also dictate that there be an attempt to limit the amount of packaging material. When a thin film is used to seal the packaging base or tray, it is also used to provide a surface for both advertising and printing required information regarding the contents of the package. Further, the printed film desirably provides a view to the contents of the compartments via clear portions on the film that are substantially devoid of printed material. As is apparent, when the package size is reduced, the space for providing the printed advertising and content information competes with the space required to provide a good size for the windows for viewing the compartment contents.

Given that children are often the primary user of these kits, it is desirable that the food package, and in particular the thin film seal thereof, be easy to open. One problem that has been identified is with packages having a compartment that contains loose food items such as candy pieces, e.g. sprinkles and M&Ms. During the peeling of the seal, the base of the package tends to flex. Accordingly, once the pulling force is removed on the seal, the base rebounds providing a spring-like action which tends to eject or propel the loose-fitting candy pieces out from their compartment spilling them onto surrounding areas.

Normally, two generally rectangularly configured packages are shrink-wrapped together for being displayed in an on-end vertical display orientation. For this purpose, the packages are generally stacked one on top of the other for shrink-wrapping the two together. Accordingly, the ability of the packages of the type considered herein to be consistently stacked in proper alignment for shrink-wrapping is important from a production standpoint. Similarly, the bases of the packages typically include stacking lugs so that the bases can be stacked during production and separated or denested one from another without significant sticking or hangup problems. These stacking lugs take up space on the base, along with the compartments themselves and the upper seal area to which the thin film seal is adhered. Accordingly, the placement of the lugs competes with space for other features provided on the base tray of the package.

Accordingly, there is a need for a compartmentalized food package for ready-to-eat food items having improved functionality in terms of both its utility to users and from display and production standpoints.

SUMMARY OF THE INVENTION

In accordance with the present invention, a food package is provided that includes a holding portion which allows a user such as children to place a food item carried by the package in a stationary position therein so that other filling and/or topping food-type items can be applied thereto. In this manner, the present food package provides a staging area that a child can use instead of placing the filling/topping receiver food item on a support surface for this purpose. In the preferred form, the holding portion has a conical configuration to act as a cone holder for cones carried in the package. This allows a user to remove one of the cones from a compartment and place it in a stationary vertical orientation in the cone holder for filling it with food products, viz. cream filling and sprinkles or M&Ms, carried in other compartments of the package base member. Alternatively, food items not carried by the package can also be combined with the held food item. Further, when the filled cone is not being eaten such as after several bites have been taken therefrom, the child can place the partially eaten cone into the cone holder as a convenient resting location so that any product filling and toppings thereon protruding from the cone are kept off of any support surface onto which the cone might otherwise be placed. Generally, the holding portion will have a matching configuration to that of the portion of the food item to be placed therein so that it is stable when held thereby.

In adding the holding portion and in particular the cone holder to the base portion, one consideration is that the material of the base member not be thinned to the point where its ability to act as a moisture barrier becomes compromised. In other words, the plastic material of the base member needs to be of sufficient thickness to provide a good moisture barrier for the food products retained in the compartments of the package, particularly where such products include sugar or wafer cones that are highly susceptible to damage via access of moisture thereto. Accordingly, in one form, the generally conical configuration of the holding portion has a tripod configuration which includes three projecting legs that can engage against the tip end of the cone when placed therein. By having a tripod configuration, a greater amount of plastic material can be employed in the cone holder area thus minimizing any thinning of a plastic material therein and keeping moisture from permeating into the cone compartment.

As mentioned, the base members are typically stacked during production thereof. Accordingly, the base members are provided with stacking lugs so as to keep adjacent bottom walls of respective stacked base members spaced from each other for ease in denesting the stacked base members from one another. Given the normal space constraints in the base members in these types of compact food packages generally, one form of the invention provides the cone holders in the stacking lug areas. As the stacking lugs include a flat, horizontal platform surface that can create hangup points for of the food products as they are inserted into the compartments during production, the combination of the holding portion drawn down from the horizontal platform surfaces keeps these hangup locations to a minimum. In other words, the holding portion need not be drawn down from a platform surface distinct from that of a lug so as to keep these horizontal surface hang-up locations to a minimum.

Additionally, the base member advantageously provides a ramp surface to the compartment of the base member, and in particular, where the base member includes several compartments including a main compartment for the filling/topping receiving food item, e.g. cones, the ramp surface or surfaces are preferably provided leading to the main compartment. In this way, should the cones engage against the ramp surface rather than be cleanly inserted into the main compartment, the cones will not get hung up such as they would on a horizontally oriented surface as discussed above, and instead will be directed or led into the main compartment along the downward incline of the ramp surface. More specifically, the ramp surface extends from the horizontally oriented, upper seal surface that extends around the perimeter of the base member and between the compartments to which the thin film seal member is adhered, and to the side wall portions of the main compartment which extend generally vertically downward therefrom. Thus, if the cones are not oriented inwardly of the side walls in the direction of the compartment space during insertion, rather than engage the horizontal seal surface, they will slide down into the main compartment along the ramp surface, as described above.

The preferred packages herein are adapted to be displayed in an on-end or vertical orientation thereof, such as with two packages shrink-wrapped together. In this orientation, the thin film seal serves as the front display of the package and is printed with advertising and content information. The main compartment is preferably disposed toward the bottom end of the base member with the base member vertically oriented, and because of the requirement of providing printed information along the bottom of the seal member, the viewing window provided through the seal member into the main compartment may not provide a good or optimum view of its contents. In other words, when the package is displayed in its vertical orientation, the food items in the main compartment shift toward the bottom end of the base member resting on the main compartment side wall adjacent thereto and for the most part out of alignment with the viewing window provided on the seal member for the main compartment. Accordingly, the preferred base member includes a spacer wall associated with the main compartment which keeps the food items in the main compartment aligned with the viewing window with the package in its vertical display orientation.

More specifically, the spacer wall extends obliquely between the upper seal surface and the main compartment side wall adjacent the bottom end of the base member so that this side wall does not depend directly from the seal surface. In this manner, the oblique spacer wall lifts the food items or cones in the main compartment into alignment for proper viewing through the main compartment window of the seal member. The spacer wall thus maximizes the surface area on the seal member for receiving printed matter between the main compartment view window and the end of the base. An additional advantage as previously discussed is that the obliquely oriented spacer wall serves as a lead-in or ramp surface for cones that are being placed into the main compartment, albeit slightly out of alignment therewith. Rather than getting hung up on the seal surface that would otherwise be in this position immediately about the perimeter of the compartment, the cone will engage on the obliquely inclined ramp surface leading the cone into the main compartment.

To allow the packages to stand on end, a back card is attached to the base member so that its bottom edge is generally aligned with the corresponding edge of the base member. The back card also serves as a location for printing nutritional and ingredient information for the package contents. In a preferred form of the packages herein, the back cards have an elongate form and extend across the full length of both the main compartment at the bottom of the package and the two upper compartments toward the top of the package containing the filling and topping food products herein. Because these fillings have a generally low melt temperature, the back card extending over the back of these compartments for the full length thereof provides a heat shield thereto such as when the packages are traveling through the shrink-wrap tunnel.

Preferably, the bottom walls of the compartments are flat and coplanar so as to allow the back card to be adhered to both the main compartment as well as the smaller compartments. So adhered, the card member acts as a stiffener for the base member to resist flexing thereof as can be caused by peeling of the seal film therefrom. Accordingly, the present package assembly is better able to avoid having its contents be ejected therefrom when the pull force on the seal member is released and the flexed base member rebounds back to its original undeformed configuration. In prior packages of this type, the back card member did not extend for the full length of the upper compartments and was not adhered thereto thus not providing the stiffening effect of the present elongate card member adhered to both the upper and lower compartments along the length of the base member.

Additionally, since the card member extends further up along the base member, and preferably past the bottom walls of the upper compartments, the card also allows the packages to be stacked more readily one on top of the other in proper alignment for being shrink-wrapped together. Normally, the stacking machine will advance one package over another for sliding over the top of the lower package. With the extra length of the back card member, it acts as a slide or sled for the upper package as it engages the seal member of the lower package to allow it to slide smoothly thereon into proper aligned position for being shrink-wrapped thereto.

DETAILED DESCRIPTION OF THE PREFERRED EMBODIMENTS

Figure 1A:
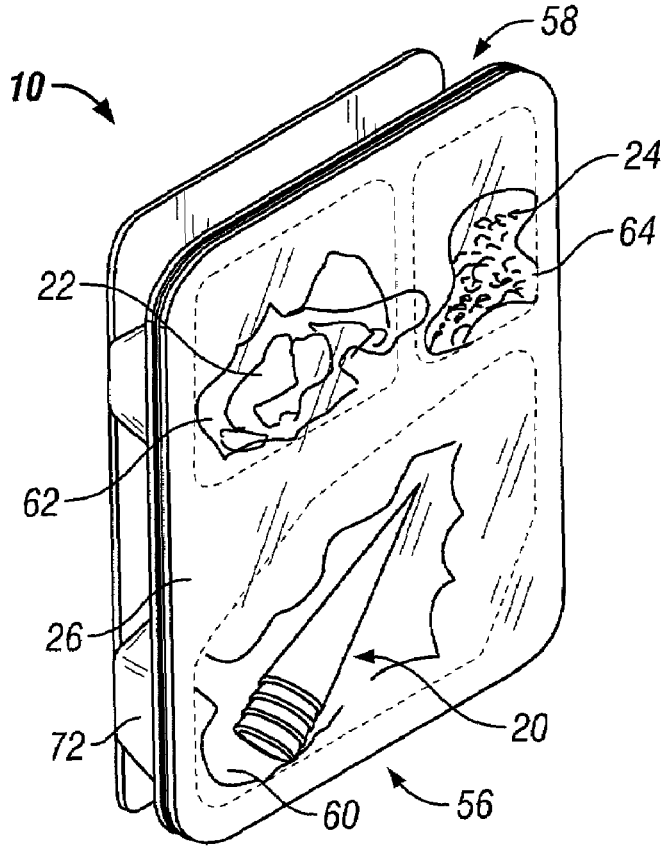
FIG. 1A is a perspective view of a food package in accordance with the present invention showing the package in its vertical, display orientation with three food item containing compartments in a base member and a thin film seal member retaining the food items therein and having windows for viewing the items.
Figure 1B:
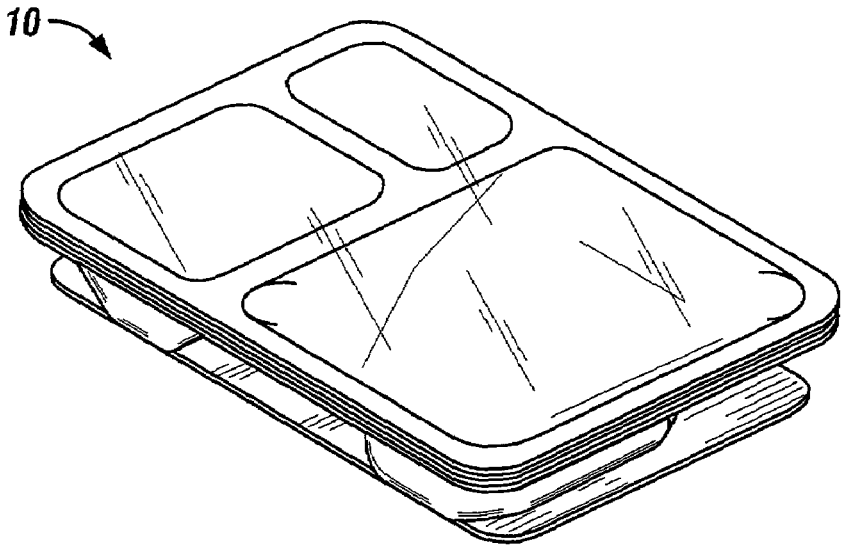
FIG. 1B is a perspective view of the food package of FIG. 1A shown in its horizontal orientation.
Figure 2:
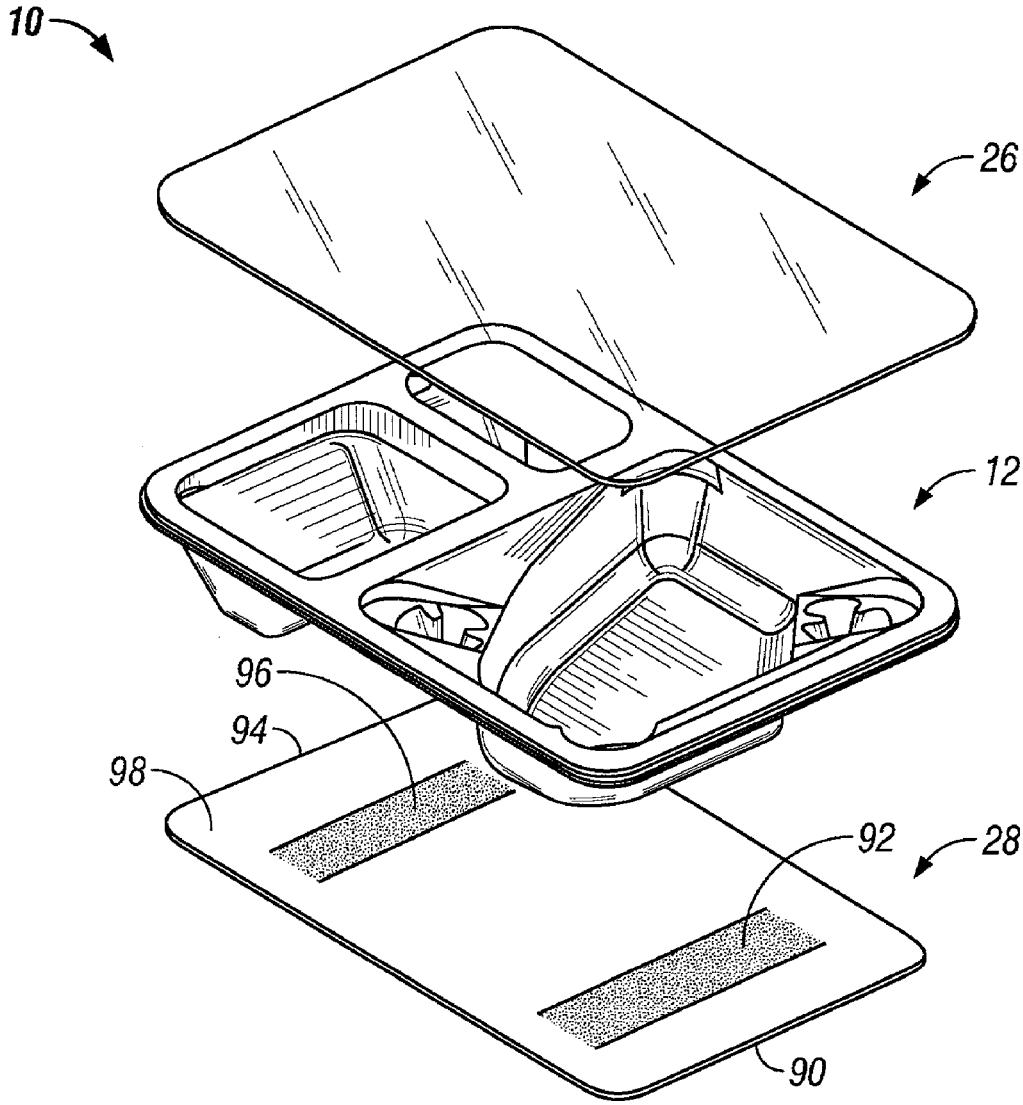
FIG. 2 is an exploded perspective view of the food package of FIGS. 1A and 1B showing the seal member and a back card member with the base member therebetween and including a pair of spaced adhesive strips.
Figure 3:
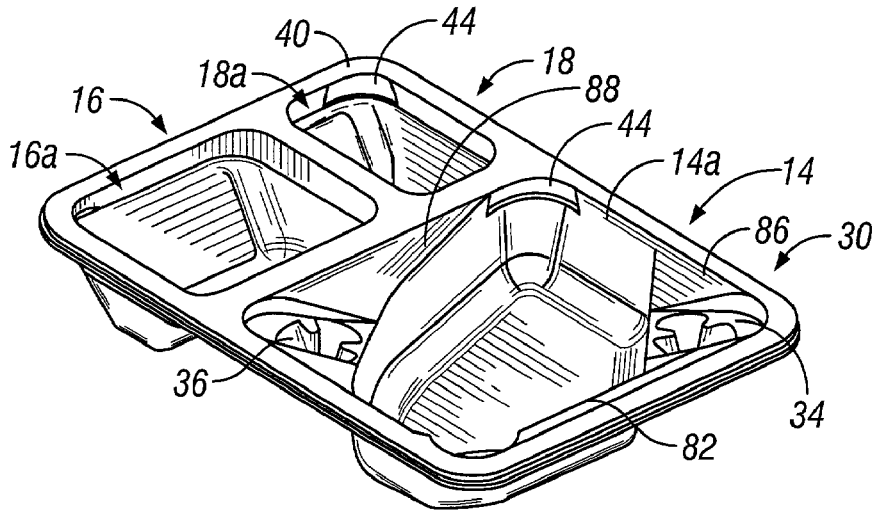
FIG. 3 is a perspective view of the base member showing the cone holders and stacking lugs positioned about the compartments of the base member.

The present invention is generally directed to food packages 10 in which there is a molded tray or base member 12 having a plurality of compartments, herein 14, 16 and 18, formed therein as by thermoforming for receipt of ready-to-eat food items such as cones 20, cone filling 22, and toppings 24, respectively, as shown in FIGS. 1A, 1B and 3. Referring to FIG. 2, it can be seen that the preferred food package 10 includes a thin film or seal member 26 as well as a back card member 28. The seal member 26 is attached to the base member 12 so as to retain the food items 20–24 in their respective compartments 14–18 prior to opening of the package 10. While the construction of the above-described multi-compartment food package 10 is the preferred form, it is manifest that the package 10 can take on other configurations from those illustrated and described herein. In particular, in various forms, the food items need not necessarily be ready-to-eat products, the base 12 need not have multiple compartments, nor need it include a back card member 28 as shown herein.

With respect to the present invention, the packages 10 are provided with a holding portion 30 that allows a user to remove one of the food items, and in particular the item 20 in the compartment 14, for being placed in a generally stationary position therein. In the preferred and illustrated form, the holding portion 30 is a cone holder for individual cones 20 carried in the large, main compartment 14 of the base member 12, although it will be recognized that the food holder 30 can be readily adapted for other food items such as pizza crusts, for instance. The cone holder 30 allows the cones that are normally disposed in a sideways orientation in the compartment 14 to be placed in the cone holder 30 in a vertical orientation. This allows a user to fill the cone 20 with fillings, such as the filling 22 provided in smaller compartment 16, as well as to apply the toppings 24 carried in small compartment 18 onto the filling 22 in the cone 20. Further, the user can employ the cone holder 30 to place the filled cone 20 therein during consumption thereof. This is of particular value for children who often take some time to eat and who would normally place the filled cone on a support surface such as a table or the like when it is not being eaten. By having the cone holder 30, the child can place the filled partially-eaten cone 20 into the holder 30 thus avoiding the problem of having the filling 22 projecting out from the partially-eaten cone engage against a table or the like on which it otherwise may be rested.

Herein, the orientation of the package surfaces and components will normally be referenced to the FIG. 1B horizontal position of the package 10. In this orientation, the seal member 42 described hereinafter is facing upward as the package 10 is conveyed during production. When the package 10 is rotated ninety degrees to stand on end or edge for display purposes as shown in FIG. 1A, such orientation generally will be identified as reference for the description of the package surfaces or walls and its components or contents.

Returning to the food holder 30, to keep the food item 20 held stable in the holding portion 30, the holding portion 30 preferably has a predetermined configuration that substantially matches the portion of the food item 20 that is placed therein. In the illustrated base member 12, the cone holder 30 for the cone 20 thus has a generally conical configuration so that tip end portion 32 of the cone 20 seats snugly therein and is supported against shifting so as to remain stationary such as during filling of the cone 20. Since only a single food item is received in the holder 30 and in a substantially stationary position therein, it can be significantly smaller than the compartment 14 in which the item is normally carried. In this regard, the cone holder 30 does not depend or extend downwardly from the top of the package for as great a distance as the compartments 14–18, e.g. 0.624 inch versus 1.095 inches.

Figure 5:
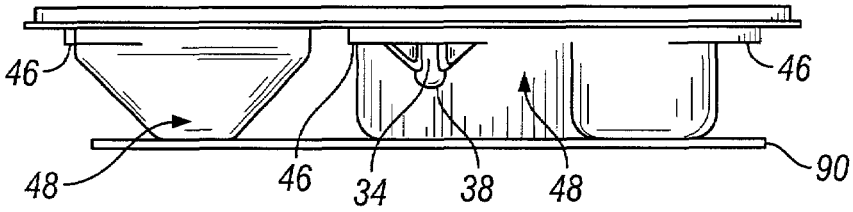
FIG. 5 is an elevational view of the base member taken along line 5—5 of FIG. 4 showing one of the cone holders adjacent the main compartment, and the back card member attached to the bottoms of both the main compartment and one of the smaller compartments.
Figure 6:
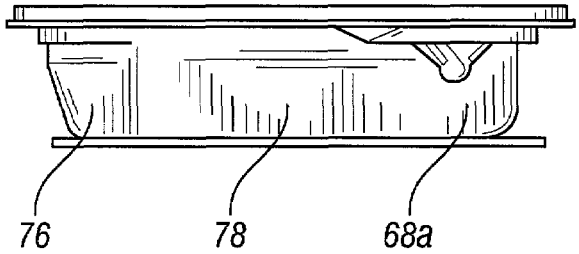
FIG. 6 is an end-elevational view taken along line 6—6 of FIG. 4 showing the other cone holder adjacent the base member main compartment.
Figure 12A:
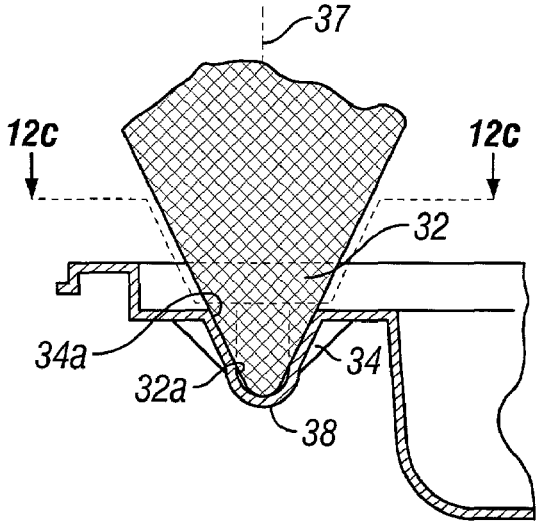
FIG. 12A is a cross-sectional view of one of the cone holders having a tip-end portion of a cone seated therein.
Figure 12B:
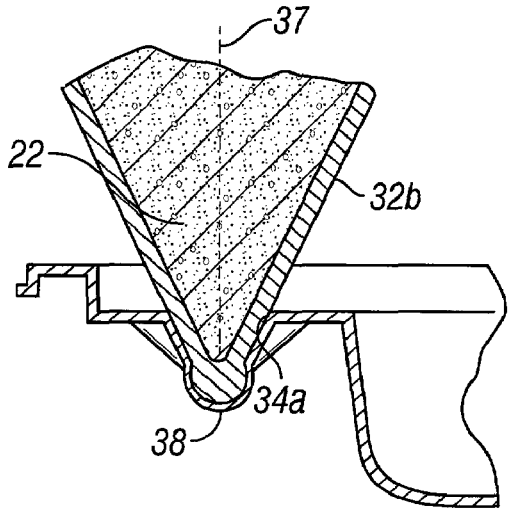
FIG. 12B is a cross-sectional view similar to FIG. 12A albeit showing a section view of the cone having a filling placed therein.
Figure 12C:
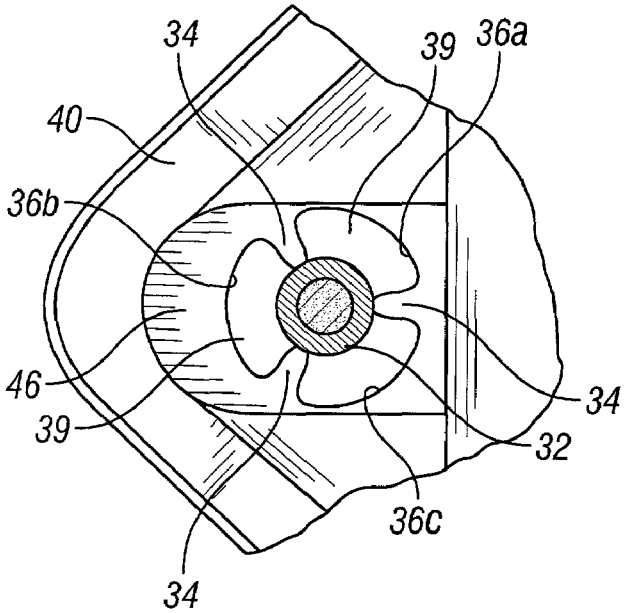
FIG. 12C is a plan view taken along line 12C—12C of FIG. 12A to show the three-point engagement of the cone tip-end portion by the three tripod legs of the cone holder.
Figure 13:
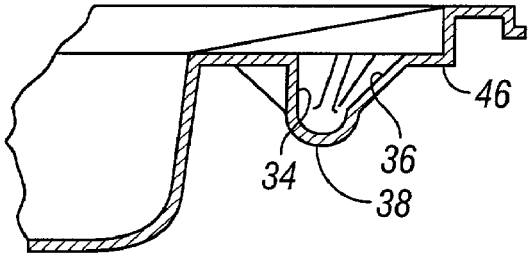
FIG. 13 is a cross-sectional view taken along line 13—13 of FIG. 4 showing one of the projecting cone holder legs.

As shown, this conical configuration for the cone holder 30 can preferably include a tripod configuration with the cone holder 30 including three depending legs 34 that project inwardly from conical surface 36 of the holder 30. Referring to FIGS. 12A and 12B, the conical surface 36 is inclined at a greater angle from vertical axis 37 than the incline on the inner surfaces 34*a* of the legs 34. The three legs 30 provide three points or areas of contact about the tip end portion 32 of the cone 20 to stabilize it against shifting when held in the cone holder 30, as can be seen in FIG. 12C. In addition, the bottom 32*a* of the cone tip end portion 32 will engage in an arcuate or semi-spherical bottom portion 38 of the holder 30 to provide the cone 20 with a fourth point or area of contact along the tip end portion 32 thereof. The cone holder bottom portion 38 is raised from the bottom of the compartments 14–18, as can be seen in FIG. 5. Accordingly, the preferred tripod cone holder 30 will engage the cone tip end portion 32 along the inclined outer conical surface 32*b* thereof via the inclined surfaces 34*a* of the projecting legs 34 and at the bottom end 32*a* thereof with the arcuate bottom portion 38 of the holder 30*a*. In this manner, the cone 20 is held securely in a stationary vertical position when placed in the cone holder 30. By way of example and not limitation, the angle from the vertical axis 37 of conical surface 36 can be approximately forty-five degrees, while the angle from the axis 37 of leg surfaces 34*a* can be approximately twelve and a half degrees.

The preferred molding process for the base member 12 is thermoforming where plastic sheet stock material is formed into configuration for the base member 12 as shown in the figures including the depending compartments 14–18, and the pair of cone holders 30 oppositely disposed relative to the main compartment 14. The compartments 14–18 and the cone holders 30 are drawn down from the plastic sheet stock for the material for the base member 12. One advantage of the tripod conical configuration for the cone holder 30 is that a greater amount of starting material can be utilized for being drawn down into the tripod configuration of the cone holder 30 for forming the projecting legs 34 about the conical surface 36. The alternative would be to have the conical surface 36 match the taper of the cone surface 32*b* which, although also contemplated by the present invention, is not as preferred as the tripod configuration because the amount of starting material for forming such a conical surface would be several orders less than that for the tripod conical configuration disclosed herein. Since there is a greater amount of starting material, there is less likelihood that there will be thin spots or areas created in the cone holder 30 during the drawdown process where moisture can permeate from external of the base member 12 into the main compartment 14 potentially damaging the cones 20 carried therein.

Further, since there are only three points of contact about the cone surface 32*b* provided by the engaging legs 34 with the conical surface 36 separated into three surface sections 36*a*–36*c* that are spaced by gaps 39 from the cone surface 32*b*, there are greater tolerances in forming of the cone holder 30 since there is less surface area of engagement with the tip portion 32 of the cone 20. Also, the cones 30 themselves are subject to manufacturing variances, and the tripod legs 34 herein are better able to provide secure support to the cones 20 despite any such variances.

Figure 4:
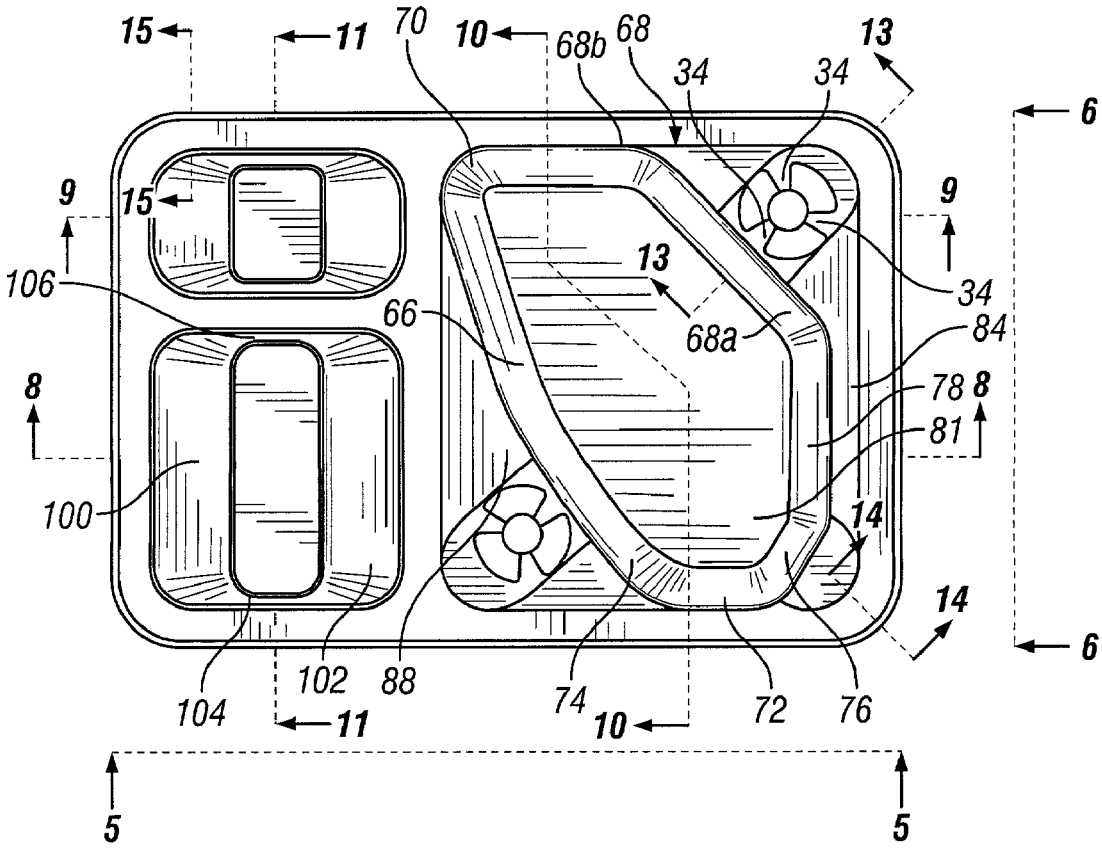
FIG. 4 is a plan view of the base member showing a tripod configuration of the cone holders oppositely disposed adjacent a main compartment that carries cones therein.

The base member 12 includes an upper seal surface 40 that extends around the perimeter thereof and between the compartments 14–18, as best seen in FIGS. 3 and 4. A seal member 42 in the form of a thin, flexible film is attached to the upper seal surface 40 so as to cover openings 14*a*, 16*a* and 18*a* to the respective compartments 14, 16 and 18 for retaining the food items 20, 22 and 24, respectively, therein. In the preferred and illustrated form, there is a pair of cone holders 30 that are adjacent the main compartment 14 and oppositely disposed across the compartment 14 with respect to each other. As the horizontal, upper seal surface 40 extends about the perimeter of the base tray 12 with the illustrated cone holders 30 spaced inwardly therefrom, the preferred seal member 42 covers not only the compartments 14–18 but also the cone holders 30.

Figure 7:
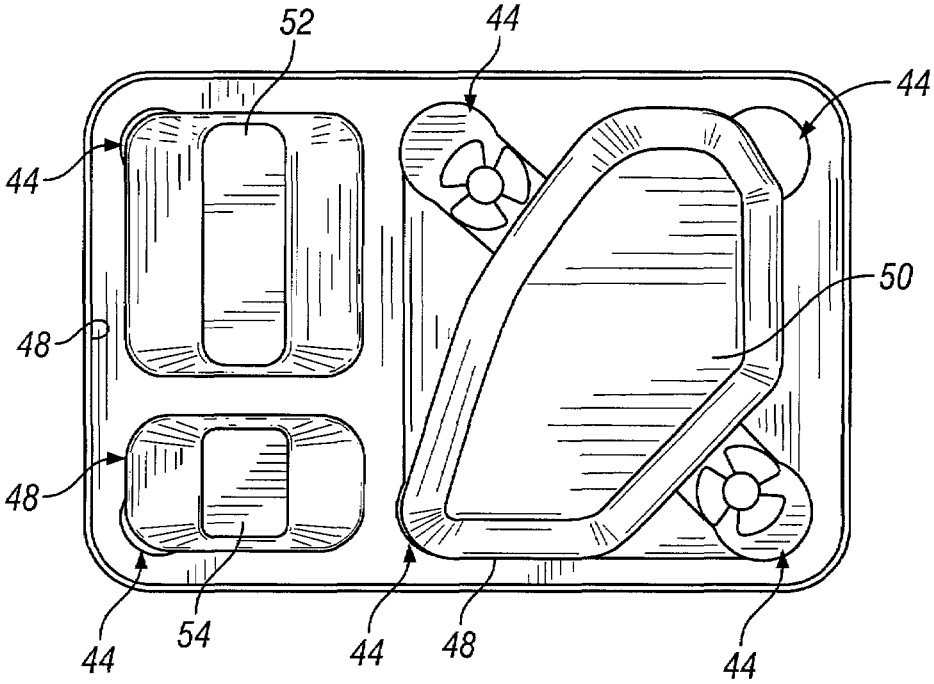
FIG. 7 is a bottom plan view of the base member showing the flat bottom walls of the base member compartments.
Figure 14:
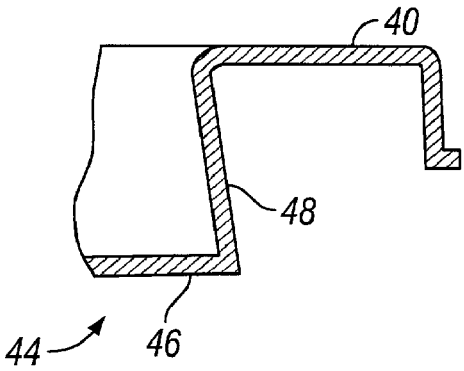
FIG. 14 is a cross-sectional view taken along line 14—14 of FIG. 4 showing a stacking lug between the main compartment and an upper seal surface of the base member.
Figure 15:
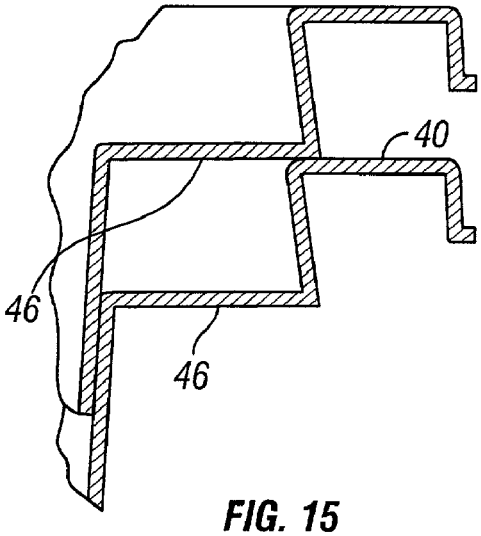
FIG. 15 is a cross-sectional view taken along line 15—15 of FIG. 4 showing two base members stacked via the stacking lug formed adjacent one of the smaller compartments.
Figure 16:
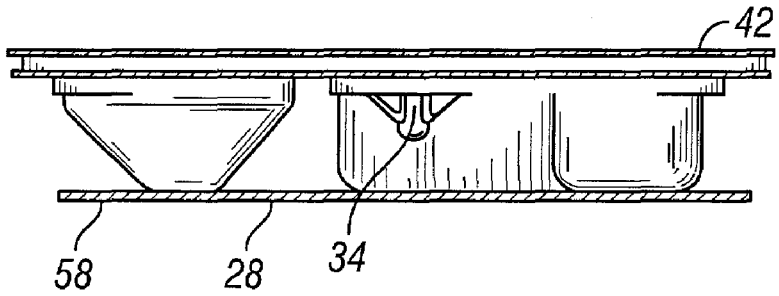
FIG. 16 is a side-elevational view of the base member similar to FIG. 5 showing the seal member attached on the upper seal surface.

The base member 12 includes a plurality of stacking lugs 44 such as depicted in FIGS. 14 and 15 which enable the base members 12 to be stacked with a vertical spacing maintained between the stacked base members 12 for ease of denesting or separating the stacked base members 12 from each other. As best seen in FIG. 7, the stacking lugs 44 are formed from upper, outer corners of each of the compartments 14–18 adjacent the corresponding corners of the base member 12 extending around the upper seal surface 40. Further, additional intermediate lugs 44 are provided approximately midway along the length of the base member 12 between the corner lugs 44 on each of the sides of the base member 12. The stacking lugs 44 each have a horizontal surface 46 which projects radially outward to an undercut or reverse angle wall portion 48 of the base member 12 that extends generally vertically upward at a slight reverse incline. In this manner, the horizontal lug surfaces 46 extend for sufficient distance so as to engage onto the upper seal surface 40 when the base members 12 are nested or stacked together, as shown in FIG. 15. The stacking lugs 44 maintain a predetermined gap spacing between the bottoms of adjacent depending features of the base members 12 including compartments 14–18 and holding portions 30 of stacked base members 12 to keep separation or denesting problems to a minimum.

The horizontal surfaces 46 of the lugs 44 provide potential hangup points for the food items, and in particular for the cones 20 when being inserted, either automatically or by hand, into the compartments, and in particular, the main compartment 14 therefor. More specifically, the compartments 14–18 are each provided with side walls, generally designated 48, extending thereabout which extend down from the compartment openings 14*a*–18*a* to bottom walls 50, 52 and 54 of the compartments 14, 16 and 18, respectively. When the cones 20 are being inserted into the main compartment 14, for example, if they engage against the horizontal surfaces 46 of the lugs 44 of the four lugs 44 spaced about the main compartment 14, they may hang up thereon rather than cleanly drop into the compartment 14 as desired. Accordingly, to minimize such hangup locations about the base member 12 and to optimize the usage of the space available on the base member 12, the holding portions 30 are preferable formed in the lug areas, as can be seen in FIG. 7. In this manner, by combining the holding portions 30 with a pair of lugs 44, the holding portions 30 do not create additional hangup locations for the cones 30 during production and do not require significant additional space be provided therefor on the base member 12.

Referring to FIG. 1A, the food package 10 is shown in its display position in a vertical orientation. The package 10 including the base member 12 thereof as shown herein has a generally rectangular configuration so that in the vertical display orientation it is supported on its bottom end 56. In this orientation, the main compartment 14 is adjacent the bottom end 56 with the compartments 16 and 18 adjacent top end 58 of the package 10 and base member 12.

The seal member 26 has windows 60, 62 and 64 for viewing the contents of the respective compartments 14, 16 and 18. There is a need for the bottom area 66 of the seal member 26 extending between the window 60 and the package end 56 to be available for printing information regarding the contents of the package 10 including such things as their description and weight. Accordingly, this predisposes the window 60 to a predetermined position spaced from the package end 56 sufficient for printing such information.

The main compartment 14 has its sidewall 48 configured to generally follow the configuration of the cones 20 so as to minimize damage thereto during normal distribution and storage. Referring to FIG. 1A, it can be seen that the cones 20 are generally nested together with three or four carried in the compartment 14 in their sideways orientation. The nested cones 20 are arranged with their tip end portion 32 up with the package 10 in its vertical display orientation. As can be seen in FIG. 4, the compartment sidewall 48 has opposite sidewall portions 66 and 68 that generally taper upwardly toward each other and meet at corner juncture 70 therebetween. In the vertical display orientation, the sidewall portion 68 has an oblique wall 68*a* and a vertical wall 68*b* whereas the sidewall portion 66 generally extends continuously in an oblique manner toward the corner juncture 70 where it meets with vertical wall portion 68*b*. Stacking lugs 44 and the cone holders 30 are formed adjacent upper ends of the sidewall portions 66 and 68*a*. The sidewall portion 66 meets short vertical sidewall portion 72 at another corner juncture 74 with the vertical sidewall portion 72 transitioning to lower, oblique sidewall portion 76. The oblique sidewall portions 68*a* and 76 generally taper toward each other from the respective vertical sidewall portions 68*b* and 72 and are interconnected by a bottom sidewall portion 78.

The bottom sidewall portion 78 extends generally parallel to the bottom end 56 of the package base member 12 so that when being advanced as by a pusher device during production, the base member 12 package does not skew on the conveyor line. Accordingly, with the nested cones 20 are placed into the compartment 14, the tip ends 32 thereof will extend toward the corner juncture 70 while the larger, open mouth ends 80 will be disposed in the compartment area 81 bounded by the sidewall portions 72–78.

Because of the need to have the sidewall portion 78 oriented in a generally parallel orientation with the package bottom end 56, the cones 20 tend to shift or drop down onto the sidewall 78 by gravity when the package 10 is pivoted to its display orientation of FIG. 1A. To keep the cones 20 aligned with the seal member window 60 in its position above the bottom end 56 of the package 10, rather than having the sidewall portion 78 depend from the upper seal surface 40 at the package bottom end 56, a spacer wall 82 is provided. The spacer wall 82 acts to lift the cones 20 as engaged with the bottom sidewall portion 78 so that the view thereof through the window 60 is not significantly obstructed, as shown in FIG. 1A. In the preferred and illustrated form, the wall portion 78 has a sizing of approximately three sixteenths of an inch in its widthwise dimension so as to lift the cones 20 vertically by a generally corresponding amount for display through the window 60.

The spacer wall 82 is inclined downwardly toward the compartment 14 so as to include a ramp surface 84 thereon that extends obliquely between the seal surface 40 and the upper end of the sidewall portion 78. Thus, the seal member 42 is preferably not adhered to the ramp surface 84. Further, the ramp surface 84 acts as a lead-in surface for cones 20 as they are being inserted into the compartment 14 that are not in clearance with the side wall 48, and in particular the sidewall portion 78 thereof. If the cones 20 engage the ramp surface 84, rather than get hungup thereon, the cones 20 will be directed into the compartment 14. As best seen in FIGS. 3 and 4, preferably there are ramp surfaces 86 and 88 also extending obliquely between the upper seal surface 40 and the main compartment sidewall portions 66 and 68*a* to minimize product hang-up problems during production.

To keep the package 10 standing on end as shown in FIG. 1A for display, the back card member 28 is attached thereto so that the bottom edge 90 is generally aligned with the package bottom end 56. In this manner, when the package 10 is tilted up into its vertical orientation, the end edge 90 and the package end 56 cooperate to provide front and back engagement points on a support surface to keep the package 10 standing. As can be seen in FIG. 2, the card 28 preferably has a rectangular configuration similar to that of the base member 12. To attach the card 28 to the base member 12, the card 28 has an adhesive strip 92 that adheres it to the outside surface of the main compartment bottom wall 50, similar to back cards used with prior ready-to-eat food packages. The present back card 28 is elongated in the lengthwise direction of the base member 12 so as to extend for the full length of not only the main compartment 14, but also the smaller compartments 16 and 18. In this regard, the card 28 has a length extending from the edge 90 to the opposite edge 94 generally only slightly less than the length of the base member between the end edges 56 and 58 thereof. By way of example and not limitation, the card member 28 can have a length of approximately 5.313 inches, and the base member 12 can have a length of approximately 5.834 inches.

Figure 17:
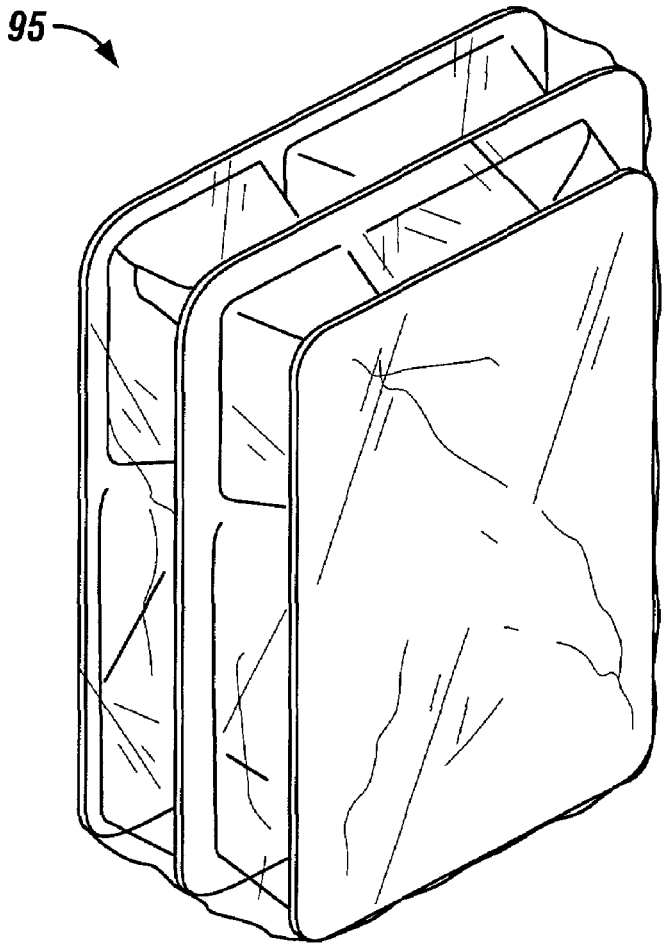
FIG. 17 is a perspective view of a pair of food packages shown shrink-wrapped together in their vertical display orientation.

By having the elongate card 28 extend for the full length of the compartments 16 and 18, and in particular the bottom walls 52 and 54 thereof, the contents of these compartments are provided with a heat shield. Because these contents can include low-melt food items such as the sweet paste or frosting-type substance for the filling 22 and chocolate-coated M&Ms for the toppings 24, it is important that they not be exposed to excessive heat such as can be generated when shrink-wrapping the package 10. In particular and referencing FIG. 17, it can be seen that an assembly 95 of two packages 10 is preferably provided by shrink-wrapping of the two together for displaying them in their vertical orientation. For this purpose, the packages 10 after being stacked and wrapped are conveyed through a shrink-wrapping tunnel to tighten the package shrink-wrapping therabout via heat applied thereto. By having the longer back card 28 herein that extends for the full length of the compartment bottom walls 50–54, there is less likelihood that excessive heat will be transmitted therethrough to the compartment contents as the card 28 will insulate the contents acting as a heat barrier therefor.

The bottom walls 50–54 are preferably aligned so as to be coplanar with each other, as shown in FIGS. 5, 8, 9 and 11. By having the longer back card 28 extending for the full length of these walls 50–54 and having the walls 50–54 in coplanar position relative to each other, the back card 28 can be provided with an additional adhesive strip 96 that extends for a sufficient lateral extent across the card 28 to span both of the laterally spaced bottom walls 52 and 54 of the smaller package compartments 16 and 18 (FIG. 7) for being adhered thereto.

Figure 18:
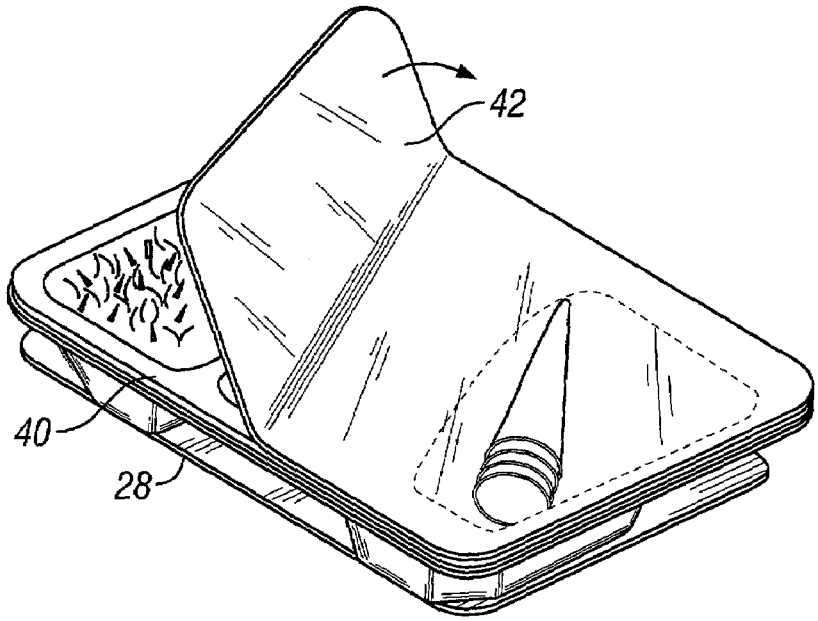
FIG. 18 is a perspective view of the food package showing the thin film seal member being peeled off therefrom with the loose food item pieces in one of the compartments staying therein.

The back card member 28 adhered to both the main compartment 14 as well as the smaller compartments 16 and 18 spaced along the length of the base member 12 acts as a stiffener resisting flexing of the package 10, and the plastic, molded base member 12 in particular. In turn, by providing a stiffer package 10, the card 28 also assists in keeping the package contents therein during the opening process when a user is peeling off the film seal 42 from the package seal surface 40, as shown in FIG. 18. In prior art packages that are either devoid of a back card as shown in FIG. 19 or which have a back card that only is adhered to the corresponding main compartment, the base member tends to flex during the peeling of the film seal therefrom.

Figure 19:
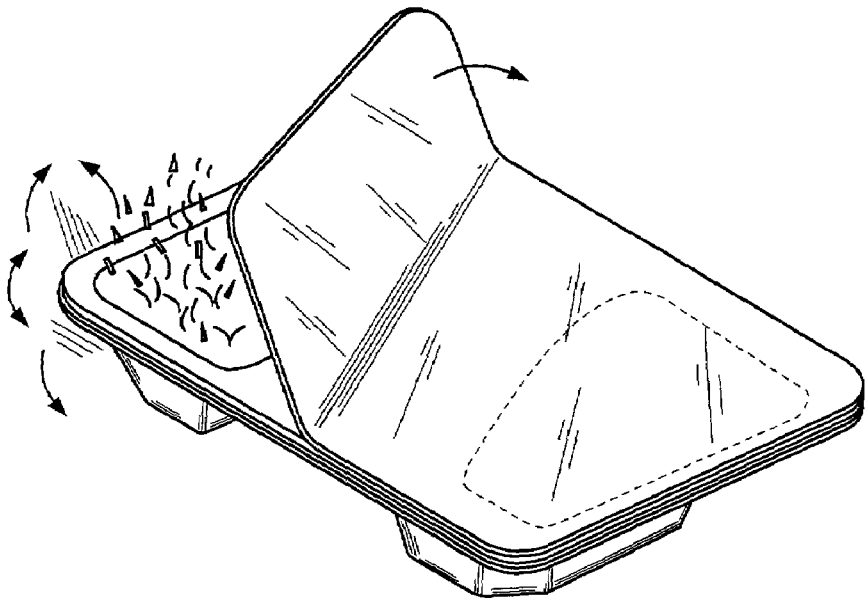
FIG. 19 (Prior Art)
FIG. 19 is a view of a prior art food package showing the seal member being peeled and the loose pieces of food items in one of the compartments being propelled therefrom due to flexing of the base member during opening of the package.

With the user holding the base member, the user applies a pull force onto the end of the seal member which tends to create a pivoting action of the base member generally transverse to its length, as indicated by the arrows in FIG. 19. When the pull force is released, the package will rebound back to its undeformed configuration creating a spring-like action on any loose items in the package compartments that are now open. Such springing action often causes the loose contents to be ejected or propelled out from the package compartment, spilling them onto the surrounding areas external of the package 10. By contrast, the back card 28 secured along the length of the back of the package 10 to the bottom walls 50–54 spaced along the length thereof, provides more resistance to pivoting of the base member 12 and thus a lesser chance of having the loose package contents, e.g. toppings 24, be propelled out therefrom with the release of the pull force on the seal member.

Another advantage of the longer back card is that in current production configurations, the packages 10 are stacked for being shrink-wrapped together by sliding of one package 10 over the other with the package end 58 being the leading end as the upper package 10 is slid over the lower package 10 in the lengthwise direction. By having the extension portion 98 of the back card 28 that projects beyond the bottom walls 52 and 54 toward the end edge 94 thereof, the card 28 is better able to slide over the top or upper seal member 26 of the underlying package 10. In this manner, the longer card 28 acts as a sled for the upper package 10 so that rather than engage the lower package seal member 26 with the compartment bottom walls 52 and 54 adjacent package end 58, the card extension portion 98 will slide smoothly thereon for stacking of the packages 10 one on top of the other. This smooth sliding action makes it less likely that the stacked packages 10 will be out of alignment for being shrink-wrapped together.

The back card 28 adhered to all of the package compartments 14–18 locks these compartments together. Where the compartments 14–18 contain food items that do not have the same weight such as with the light weight cones 20 versus the heavier filling 22 and toppings 24, the disadvantages that this unbalanced weight distribution presents in handling of the packages 10 during production are minimized since the compartments 14–18 are more rigidly tied together by the back card 28 adhered thereto.

Figure 8:
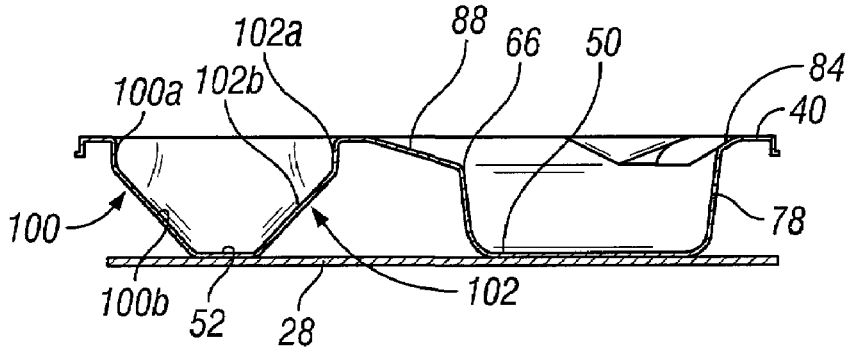
FIG. 8 is a cross-sectional view taken along line 8—8 of FIG. 4 showing ramp surfaces leading to the main compartment and tapered walls of one of the smaller compartments.
Figure 9:
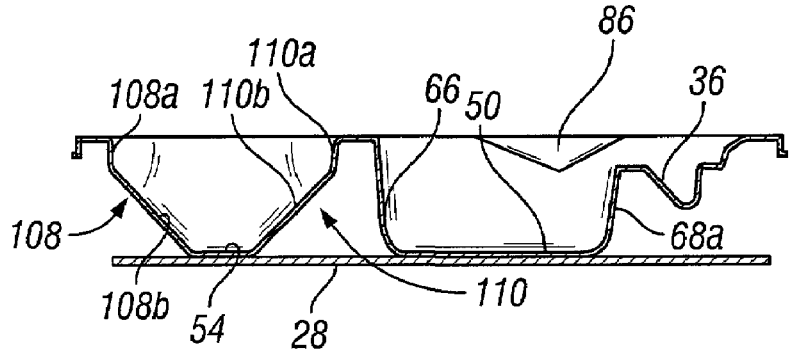
FIG. 9 is a cross-sectional view taken along line 9—9 of FIG. 4 showing one of the tripod cone holders including one of the projecting legs thereof and tapered walls of the other smaller compartment.
Figure 10:
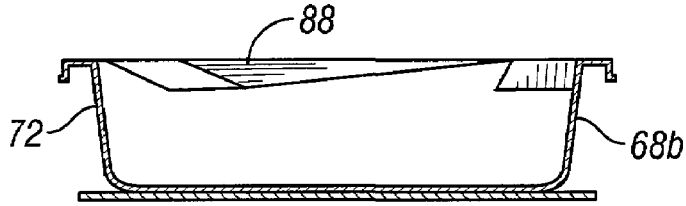
FIG. 10 is a cross-sectional view taken along line 10—10 of FIG. 4 showing one of the ramp surfaces leading to the main compartment.
Figure 11:
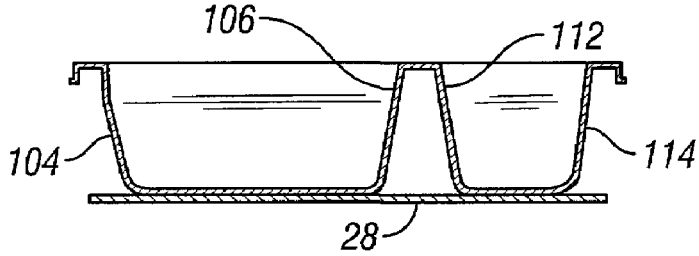
FIG. 11 is a cross-sectional view taken along line 11—11 of FIG. 4 showing slightly tapered side walls of the smaller compartments of the base member.

Turning to more of the details, the main compartment sidewall portions 66, 68, 72, 76 and 78 all preferably taper slightly inwardly as they extend down to the compartment bottom wall 50, as can be seen in FIGS. 8–10. On the other hand, the smaller compartments 52 and 54 are each provided with opposite sidewall portions that taper at a much greater incline than the main compartment sidewall portions so that the contents thereof are pushed up toward the seal member 26 and the windows 62 and 64 formed therein for providing a better view of the food items 22 and 24. More specifically and referencing FIGS. 4 and 8, the filling compartment 16 is provided with opposite sidewall portions 100 and 102 that have respective short vertical sections 100*a* and 102*a* depending from upper seal surface 40. The sidewall portions 100 and 102 then taper sharply toward each other via inclined sections 100*b* and 102*b* to the bottom wall 52, as best seen in FIG. 8. Referring to FIGS. 4 and 11, interconnecting sidewall portions 104 and 106 extend between the sidewall portions 100 and 102 and are provided with only a slight taper akin to that of the sidewall portions for the main compartment 14.

The sidewall portions of the other small compartment 18 containing the toppings 24 are similarly configured in terms of their taper to the sidewall portions 100–106 of the compartment 16 with the illustrated compartment 18 being even smaller than the compartment 16. More specifically and referencing FIGS. 4 and 9, the compartment 18 has oppositely disposed sidewall portions 108 and 110 each including respective short vertical sections 108*a* and 110*a* depending from upper seal surface 40 with sharply inclined surface sections 108*b* and 110*b* tapered toward each other to the compartment bottom wall 54. Referring to FIGS. 4 and 11, interconnecting side wall portion 112 and 114 extend between the sidewall portions 108 and 110 and are provided with only a slight taper akin to that of main compartment sidewall portions. Whereas the opposite sharply tapering sidewall portions 100, 102 and 108, 110 of the respective compartments 16 and 18 have the same spacing between each other so that the small compartments 16 and 18 have the same size in the length dimension of the base member 12, the spacing between the sidewall portions 104 and 106 is approximately twice that of sidewall portions 112 and 114 so that the filling compartment 16 is bigger and twice as wide as the toppings compartment 18.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

We claim:

1. A food package for containing cones and food products being filled into the cones, the food package comprising:

a base member having a plurality of compartments including a large main compartment in which the cones are carried and configured so that the cones rest on sides thereof, and smaller compartments in which the food filling products are carried;

openings to the compartments through which the cones and food filling products are placed therein;

a flexible seal member attached to the base member to seal the compartment openings and retain the cones and food products therein; and a cone holder of the base member having a generally conical configuration for receiving one of the cones therein to keep the cones in a substantially vertical orientation thereof to allow a user to fill the cone with the food products and to place the filled cone therein when the filled cone is not being eaten, the cone holder being adjacent one of the compartments with the flexible seal member extending over the cone holder so that removal of the seal from the base member allows a cone to be removed from the large main compartment and placed in the cone holder.

2. The food package of claim 1 wherein the base member includes an upper seal surface extending about the compartment openings and to which the seal member is attached, and a ramp surface extending at an oblique angle therefrom into the main compartment to minimize hang-ups of cones during placement thereof into the main compartment.

3. The food package of claim 1 wherein the base member has spaced ends with the main compartment adjacent one of the ends and a vertical display orientation thereof with the one end supporting the base member vertically, the seal member includes a window spaced from the one end, and a spacer wall of the base member that orients the main compartment for viewing of the cones therein through the seal member window with the base member in the vertical display orientation thereof and maximizes surface area for receiving printed matter on the seal member between the window and the one end of the base.

4. The food package of claim 3 wherein the main compartment includes a side wall portion adjacent the base member end with the cones resting on the side wall portion with the base member in the vertical display orientation thereof, the base member includes an upper seal surface extending about the opening of the main compartment, and the spacer wall extends obliquely between the seal surface and the side wall portion to lift the side wall portion and cones resting thereon into position for viewing through the seal member window with the base member in the vertical display orientation.

5. The food package of claim 1 wherein the compartments include bottom walls and side walls extending therearound, the base member includes stacking lugs extending transverse to the side walls to keep adjacent bottom walls spaced from each other in respective stacked base member, and the cone holder depends from one of the stacking lugs to minimize space requirements therefor.

6. The food package of claim 1 wherein the cone holder includes a plurality of projecting legs extending therein to engage the cone at spaced locations thereabout and keep the cone securely held in the vertical orientation thereof.

7. The food package of claim 1 wherein the base member is of a plastic material, and the cone holder is smaller than the compartments and has a tripod conical configuration to avoid thinning of the plastic material in the small cone holder.

8. The food package of claim 1 wherein the food filling products include a sweet paste substance in one of the smaller compartments and candy pieces in another small compartment, and an elongate back card extending for the full length of the main and small compartments and secured thereto to provide a heat barrier for the paste substance and candy pieces in the small compartments and to provide rigidity to the base member to minimize flexing of the base member during separation of the seal member therefrom for keeping the candy pieces in the small compartment.

9. The food package of claim 1 wherein the food filling products in the smaller compartments are heavier than the cones in the larger main compartment, and a back card adhered to both the smaller compartments and the larger main compartment to lock the compartments together.

10. The food package of claim 1 wherein the base member includes an upper perimeter seal surface that is flat for an extent thereof without openings therein to securely receive the seal member thereon, and the cone holder is generally positioned adjacent the main compartment and has an upper opening lower than the seal surface.

* * * * *

UNITED STATES PATENT AND TRADEMARK OFFICE

CERTIFICATE OF CORRECTION

PATENT NO. : 7,041,326 B2
APPLICATION NO. : 10/112591
DATED : May 9, 2006
INVENTOR(S) : Bradley et al.

It is certified that error appears in the above-identified patent and that said Letters Patent is hereby corrected as shown below:

On the title page item (56), column 2, under Foreign Patent Documents, entry 1, after "3/2001", insert -- A21D 15/00 --.

On the title page item (56), column 2, under Foreign Patent Documents, entry 2, after "10/1995", insert -- B65D 81/32 --.

On the title page item (56), column 2, under Foreign Patent Documents, entry 3, after "11/2000", insert -- A21D 15/00 --.

On the title page item (56), column 2, under Foreign Patent Documents, entry 4, after "11/2001", insert -- A23G 03/00 --.

On the title page item (56), column 2, under Foreign Patent Documents, entry 5, after "4/1985", insert -- B65D 81/32 --.

Signed and Sealed this

Third Day of October, 2006

JON W. DUDAS
*Director of the United States Patent and Trademark Office*